US006935875B1

(12) United States Patent
Holden

(10) Patent No.: US 6,935,875 B1
(45) Date of Patent: Aug. 30, 2005

(54) UNIVERSAL COMPUTER CABLE CONNECTOR PROTECTOR COVER

(76) Inventor: Jerry L. Holden, 1990 Ike Adcock Rd., Smithville, TN (US) 37166

( * ) Notice: Subject to any disclaimer, the term of this patent is extended or adjusted under 35 U.S.C. 154(b) by 0 days.

(21) Appl. No.: 10/805,076

(22) Filed: Mar. 20, 2004

(51) Int. Cl.[7] ..... H01R 13/44
(52) U.S. Cl. ..... 439/144; 439/372
(58) Field of Search ..... 439/372, 142, 439/144, 355, 135–136, 133–134; 174/135, 174/66–67; 361/683, 679; 70/57–58, 158–173

(56) References Cited

U.S. PATENT DOCUMENTS 4,898,009 A * 2/1990 Lakoski et al. ..... 70/58
5,199,888 A * 4/1993 Condra et al. ..... 439/142
5,507,664 A * 4/1996 Carmo ..... 439/372
6,557,385 B1 * 5/2003 Shih ..... 70/159

* cited by examiner

*Primary Examiner*—Gary Paumen
*Assistant Examiner*—Felix O. Figueroa
(74) *Attorney, Agent, or Firm*—Jeffrey C. Maynard

(57) ABSTRACT

The present invention provides a cable connector cover having an access door hingedly mounted to a base. The base enables alignment and connection to a computer adjacent to a PCMCIA port. A top mounting plate overlaps a portion of the computer frame to secure the cable connector cover in place. When the access door is in the open position, a cable can be inserted therein to establish a connection at such PCMCIA port. The access door can then be closed to hold the connector in place. A cable clamp also provides stress relief for the computer cable.

11 Claims, 12 Drawing Sheets

UNIVERSAL COMPUTER CABLE CONNECTOR PROTECTOR COVER

BACKGROUND OF THE INVENTION

1. Field of the Invention

The present invention relates to a computer connector cover mechanism, and more particularly, to a connector cover mechanism for supporting and holding a computer cable connected to a supporting body.

2. Background of the Prior Art

There are a variety of locking or latching designs or systems in the electrical connector art for connecting a cable to an electrical instrument, such as a computer chassis. In some latching systems, the connector utilizes a claw-like securing structure. Many connectors use a pair of thumbscrews that attach to a female receptacle on the computer chassis. This type of latching system has its disadvantages, however. Because of the receptacles being generally loosely attached to a card internal to the computer, the thumbscrews are apt to become disengaged. If sufficient tensile stress is put on the connector, it can become disengaged, or worse, it can unseat the card from the computer. Therefore, an additional latch is often used to provide integrity to the latching structure.

However, given the propensity of users to attempt to hastily remove the cable assembly from the computer, and given the fact that various computers currently used are portable and therefore operate in unconventional environments, it also is desirable to have a connector latching structure that holds the cable securely to the computer.

Consequently, there exists an unfulfilled need for an apparatus to simply and securely hold a computer cable to a computer. Such apparatus should be easy to operate and sturdy enough to prevent a cable from release until desired.

SUMMARY OF THE INVENTION

It is, therefore, an object of the present invention to provide a computer cable protector cover that avoids the disadvantages of the prior art.

Another object of the present invention is to provide a cable connector cover that can be quickly and efficiently engaged and disengaged to a computer. A related object is to provide a cable connector cover that can securely align and hold a computer cable.

It is a further object of the present invention to provide a cable connector cover that is rugged and durable.

The above and other objects, features, and advantages of the present invention are described in more detail with reference to the accompanying drawings.

According to a first aspect, the present invention provides a cable connector cover having an access door hingedly mounted to a base. The base enables alignment and connection to a computer adjacent to a PCMCIA (Personal Computer Memory Card International Association) port. A top mounting plate overlaps a portion of the computer frame to secure the cable connector cover in place. When the access door is in the open position, a cable can be inserted therein to establish a connection at such PCMCIA port. The access door can then be closed to hold the connector in place. A cable clamp also provides stress relief for the computer cable.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following detailed description, which should be read in conjunction with the accompanying drawings. This detailed description of an embodiment, set out below to enable one to build and use an implementation of the invention, is not intended to limit the invention, but to serve as a particular example thereof. Those skilled in the art should appreciate that they may readily use the conception and specific embodiment disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
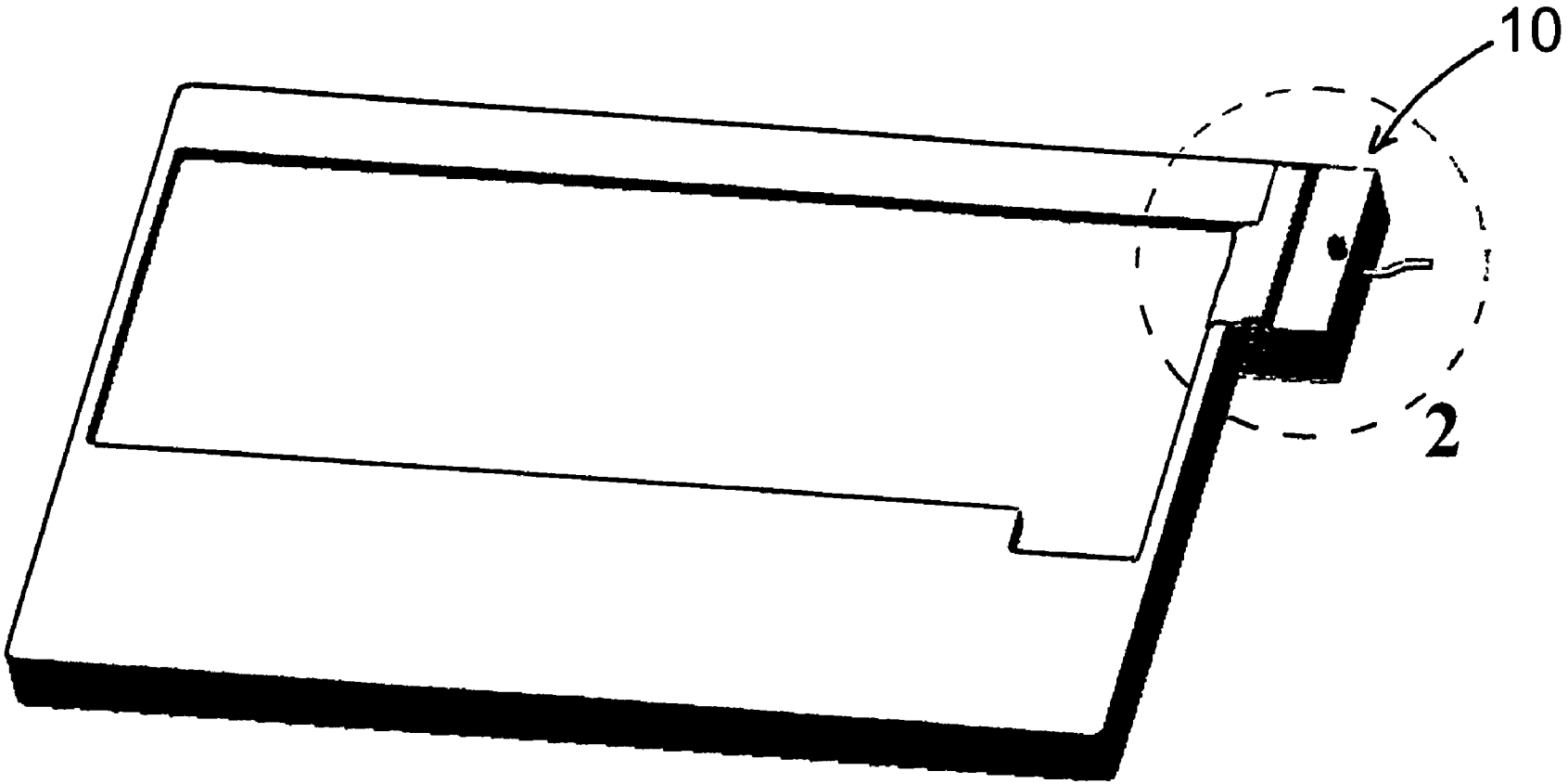
FIG. 1 is a view of an embodiment of the present invention installed on a computer input device.
Figure 2:
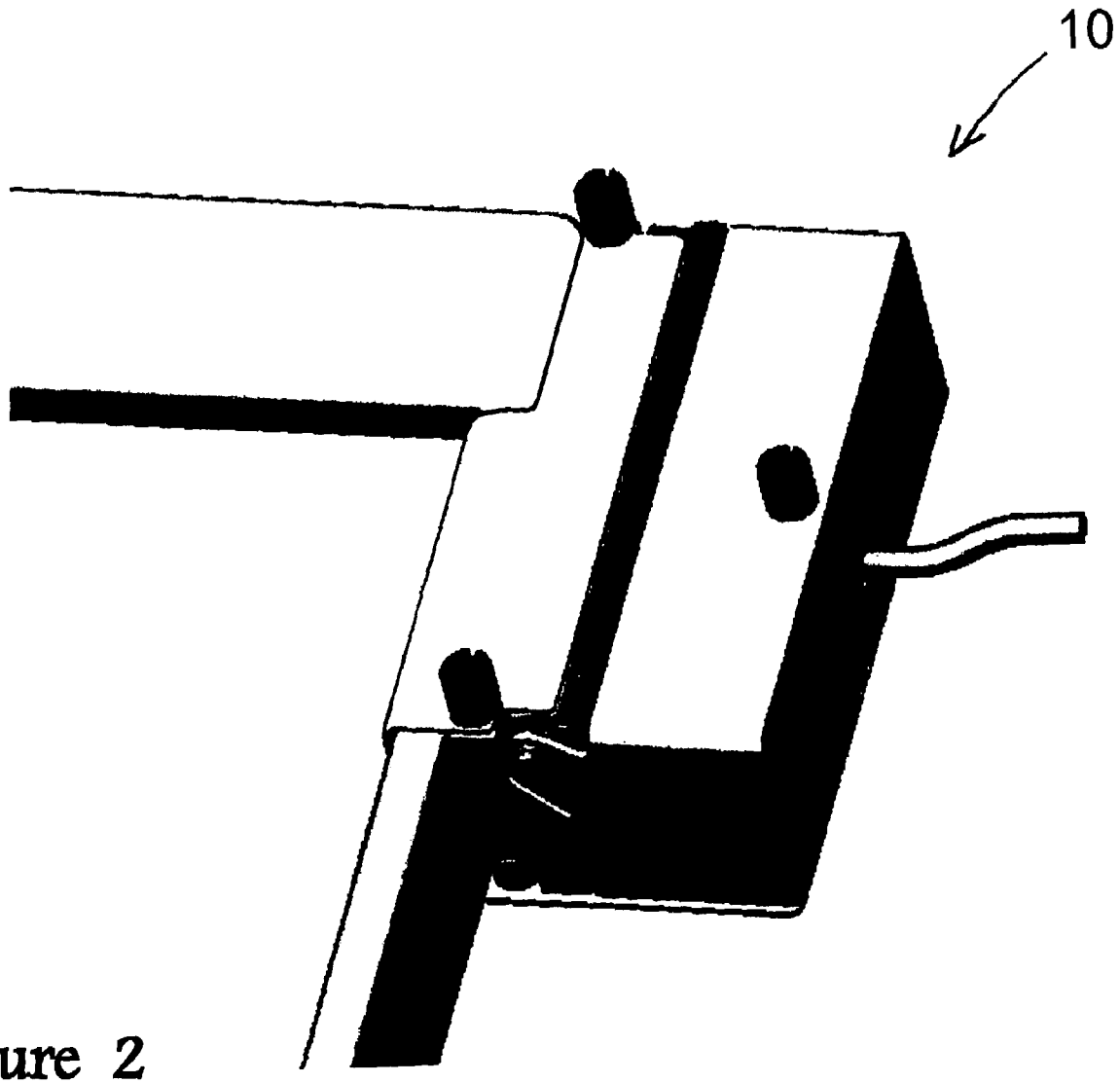
FIG. 2 is an enlarged portion of FIG. 1.
Figure 3:
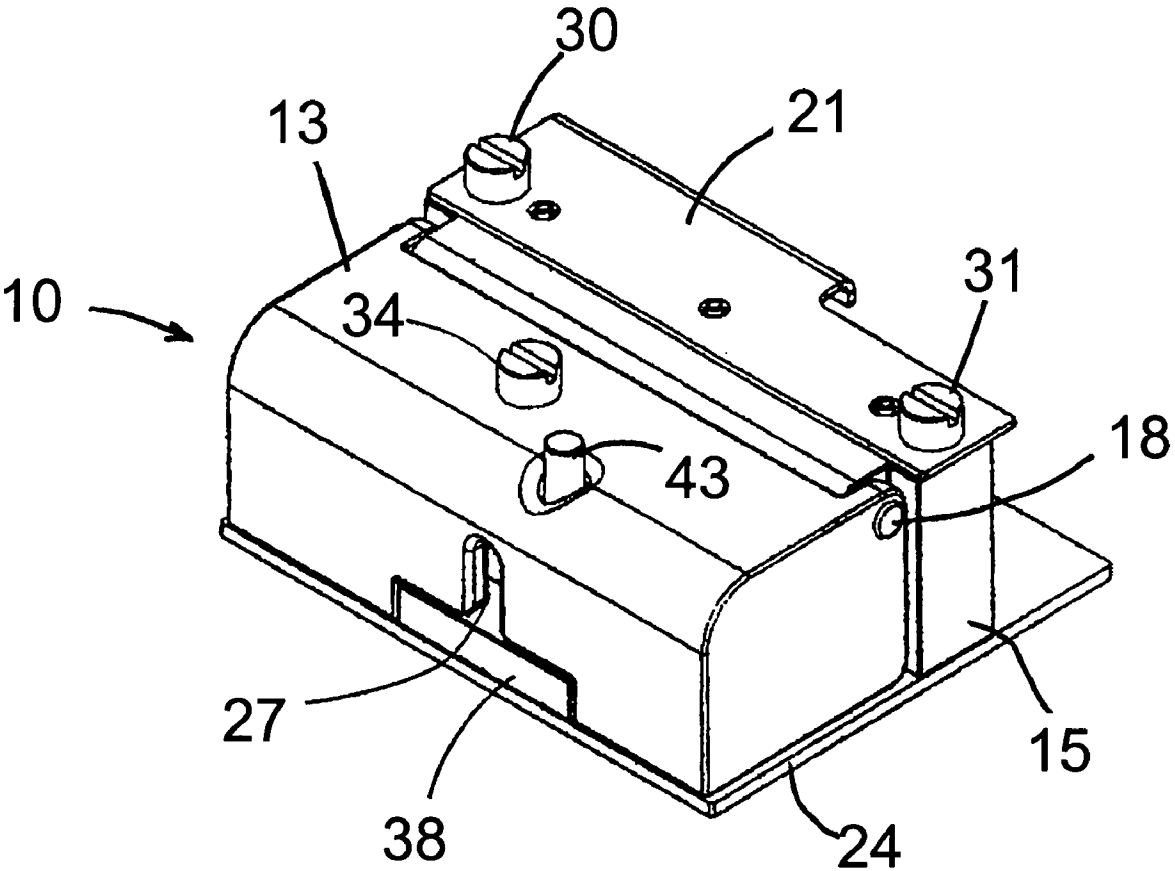
FIG. 3 is a perspective view of an assembly of the apparatus according to the present invention.

FIGS. 1 and 2 show an assembly according to the present invention, indicated generally as 10, attached to a computer input device. As shown in FIGS. 3–6, the apparatus includes an access door 13 hingedly mounted to a base 15 by hinge pin 18. Assembly 10 further comprises an upper mount plate 21 and a lower plate 24. A cable aperture 27 in the front of access door 13 enables a computer connector cable to pass out of assembly 10. A pair of thumbscrews 30, 31 permits adjustable tightening of upper mount plate 21 in a mounted position. Thumbscrews 30, 31 can be replaced by or augmented with flathead screws. In ether case, such screws should have retainer clips to prevent loss during cleaning or insertion. Thumbscrew 34 holds access door 13 in a closed position, such as shown in FIGS. 1 and 2. A portion 38 of base 15 may extend out of the front of access door 13. Such portion 38 of base 15 provides vertical support for a computer cable connector when such cable is attached to a computer. Such portion 38 supports the bottom portion of a cable fastener, the top portion comprising cable clamp element 41 (best seen in FIG. 7) and clamp knob 43.

Figure 4:
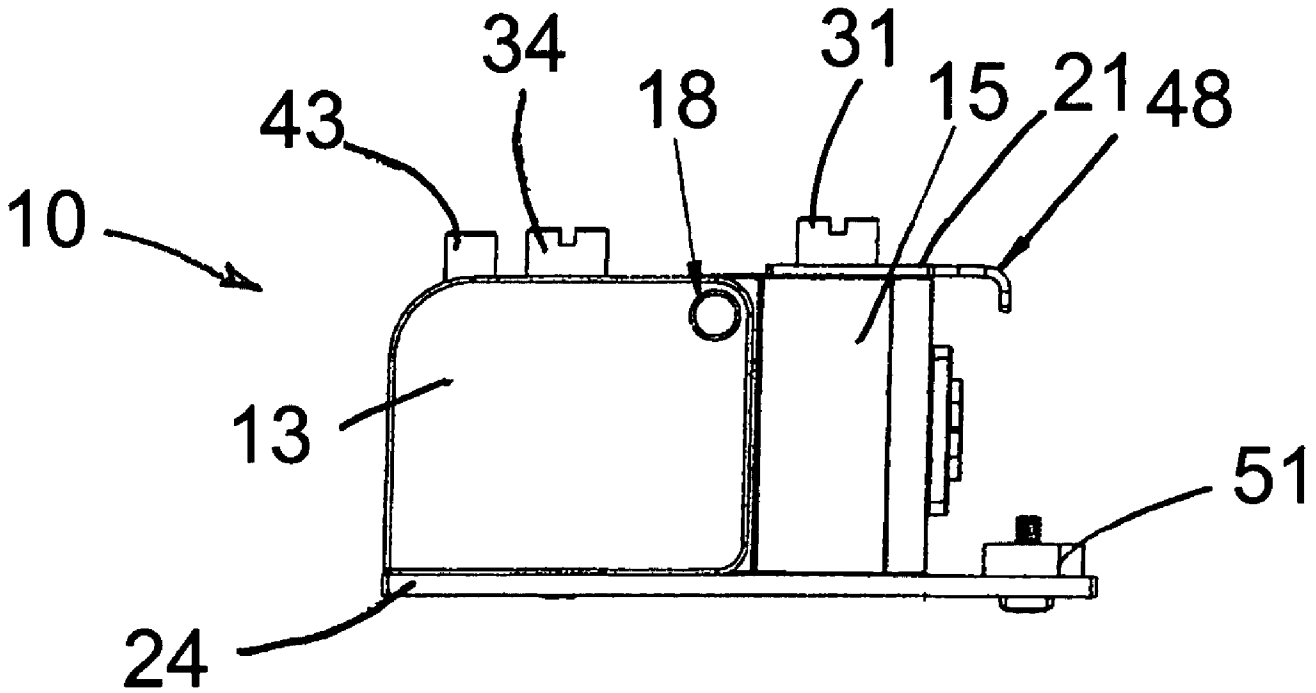
FIG. 4 is a side elevational view of the apparatus of FIG. 3.
Figure 5:
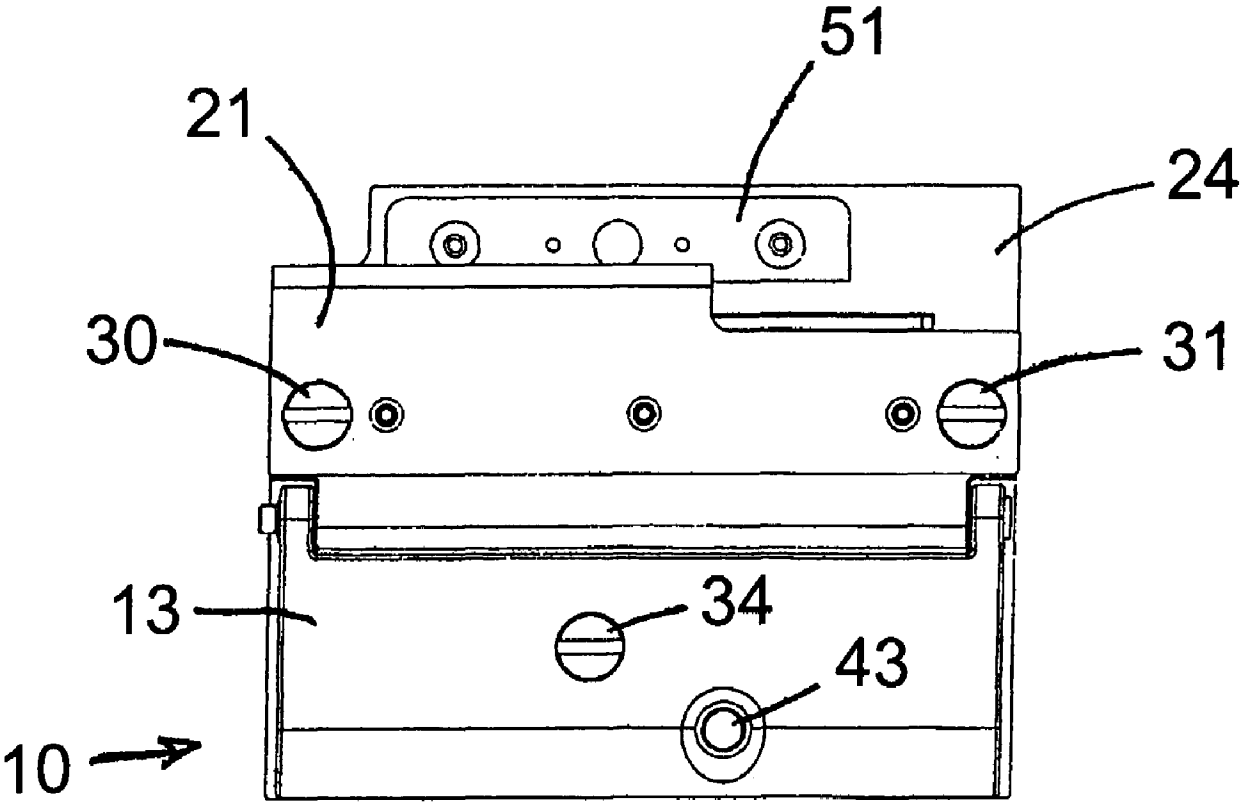
FIG. 5 is a top plan view of the apparatus of FIG. 3.
Figure 6:
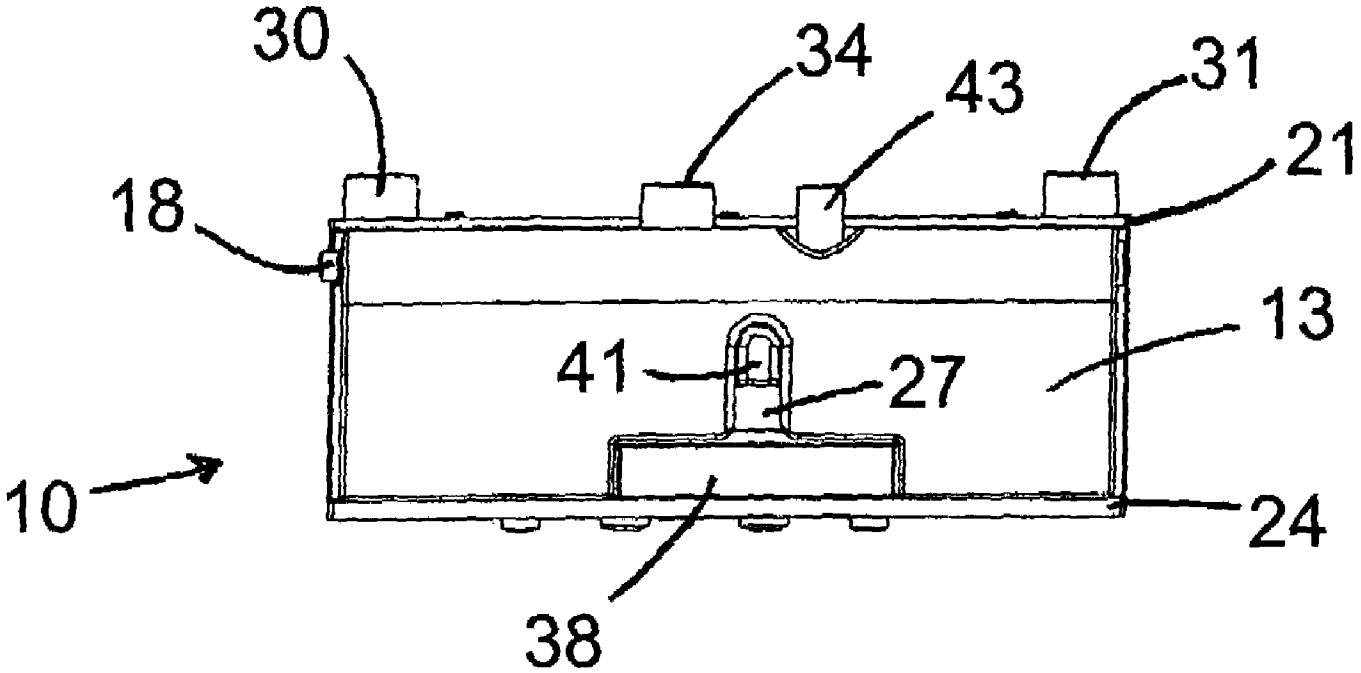
FIG. 6 is a front elevational view of the apparatus of FIG. 3.

Referring to FIG. 4, at least a portion of upper mount plate 21 defines a generally curved hook segment 48. The hook segment 48 is preferably curved slightly and hooked downwardly, to form an attachment when mounted to a computer. An alignment plate 51 attached to lower plate 24 assists in connecting assembly 10 to a computer such that a computer cable can be easily aligned for connection to the computer PCMCIA port or other type of connector port.

Assembly 10 is sized and configured to enable a pair of computer cables to be attached to a pair of ports, vertically oriented on such computer. In such a case, said pair of cables should be stacked with one cable connector on top of another cable connector.

Figure 7:
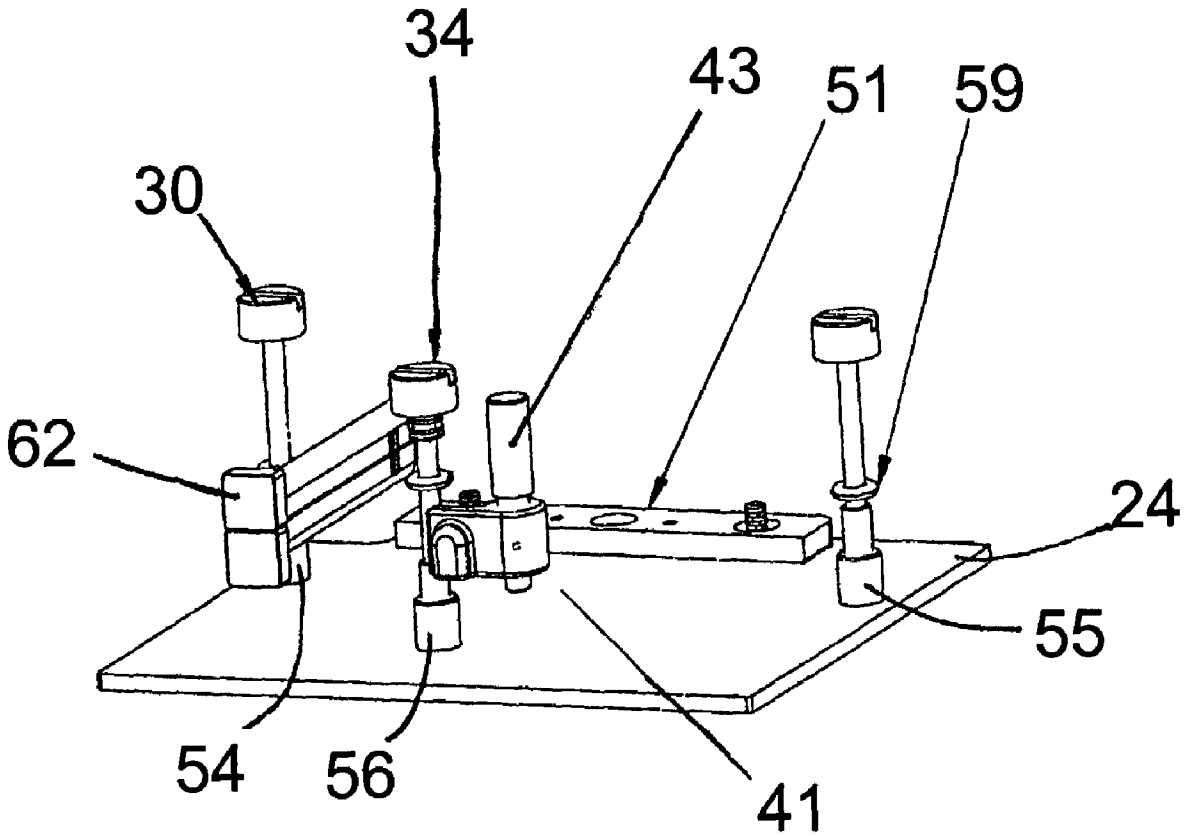
FIG. 7 is a perspective view of the inner components of the apparatus of FIG. 3.

As shown in FIG. 7, lower plate 24 presents three screw sockets 54, 55, 56 having internal threaded portion for receiving thumbscrews 30, 31, 34. Each such thumbscrew may preferably include a thumbscrew retainer, such as 59. In some embodiments, an eject button 62 may be provided to assist in removal of a computer cable. When only one cable is attached to the computer within the protector assembly 10, cable clamp 41 is pivoted in a position substantially parallel to the front of access door 13. Clamp knob 43 is threadably engaged in cable clamp 41, such that rotation of clamp knob 43 about its longitudinal axis will cause cable clamp 41 to pivot into the clamping position and rotation of clamp knob 43 in the opposite direction will position cable clamp 41 substantially perpendicular to the front of access door 13 to enable a pair of cables to pass through cable aperture 27.

Figure 8:
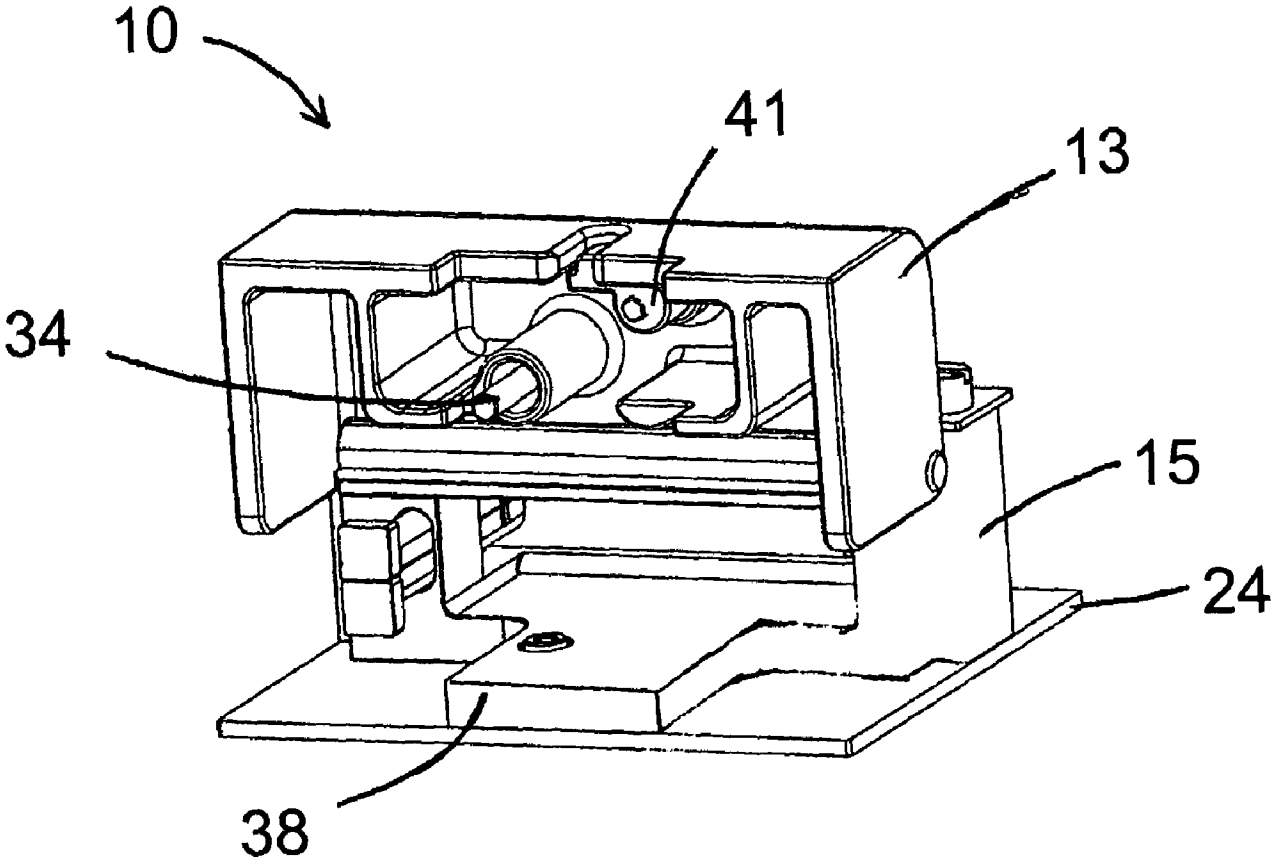
FIG. 8 is a perspective view of the apparatus of FIG. 3, with the cover open.

In FIG. 8, assembly 10 is shown with access door 13 in an open position. Using thumbscrew 34 on access door 13, a user can rotate the access door 13 out of the way, providing access to enable a computer cable to be attached to a computer PCMCIA port or other type of connector port. A computer cable connector would rest on the base 15, at an appropriate height determined by front portion 38. Once the cable is attached to the computer, the clamp knob 43 is rotated to pivot cable clamp 41 into the clamping position and access door 13 is rotated to a closed position and thumbscrew 34 is tightened to hold the access door 13 in such closed position and to push cable clamp 41 against a portion of the cable to hold the cable in place.

Figure 9:
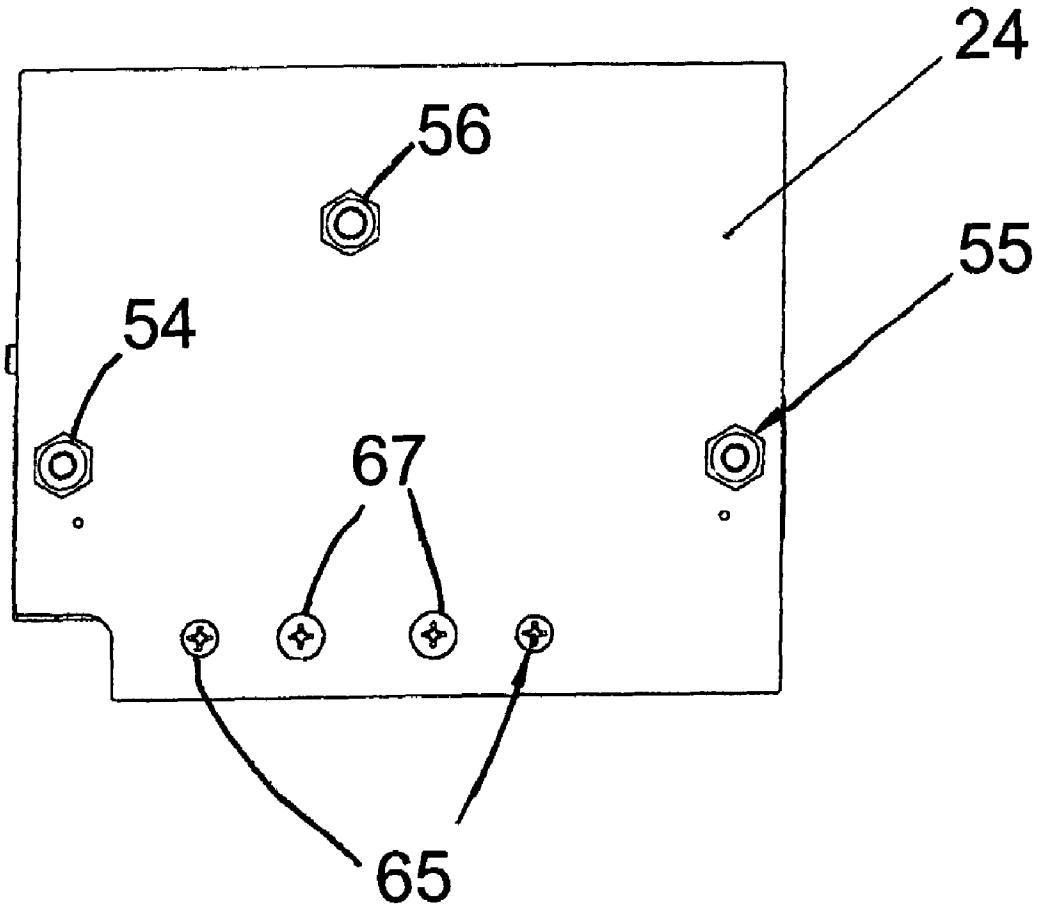
FIG. 9 is a bottom plan view of the apparatus of FIG. 3.

Lower plate 24, shown in FIG. 9, has the bottom portion of screw sockets 54, 55, 56 disposed therein. Mounting screws 65 permit attachment of the assembly 10 to a computer. Alignment screws 67 are used in conjunction with alignment plate 51 (FIG. 4) to align the assembly 10 to the computer.

Figure 10:
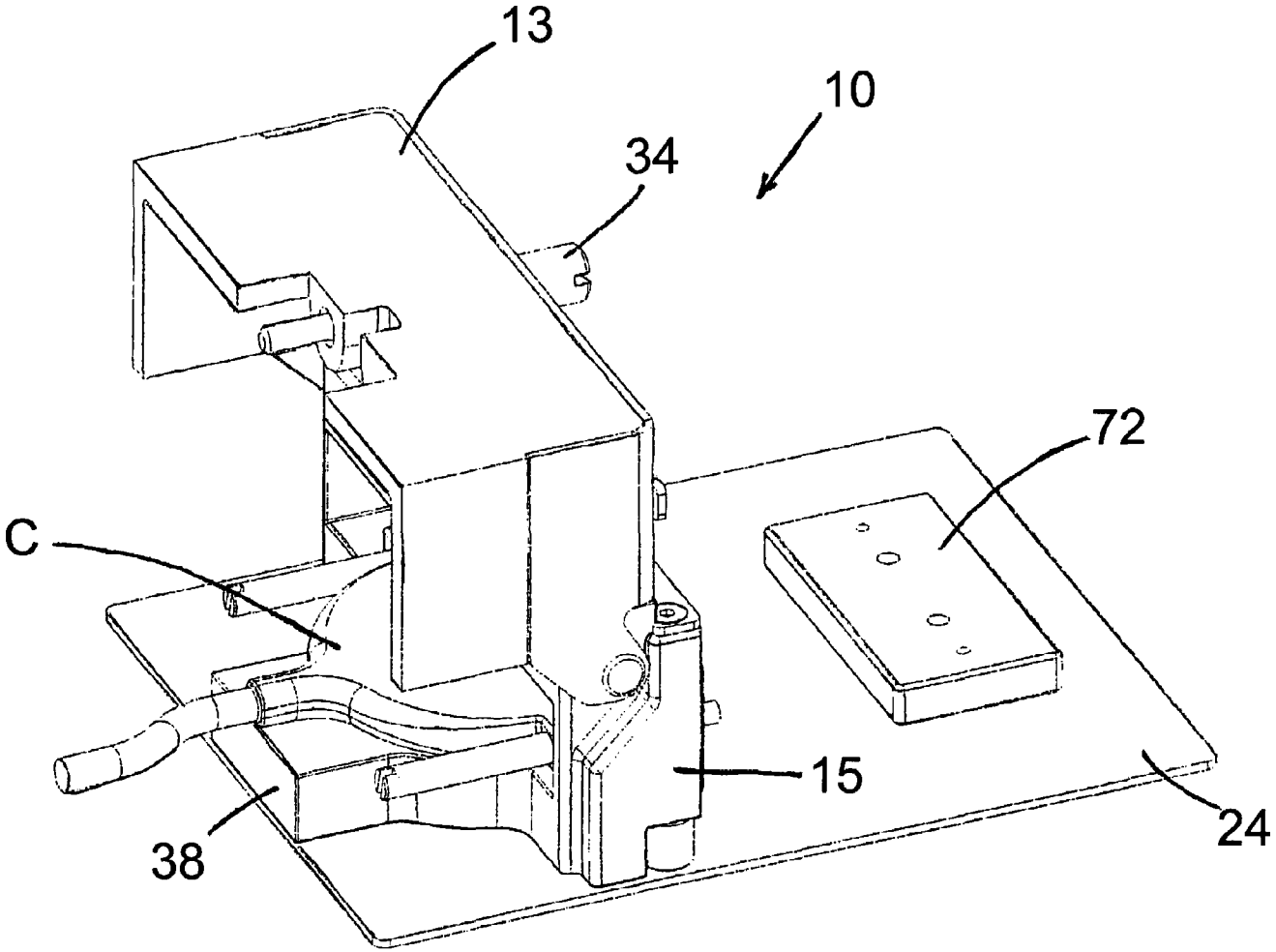
FIG. 10 is a perspective view of an apparatus according to the present invention with a computer cable connector.

FIG. 10 shows an assembly 10 according to the present invention with a single computer cable connector C in position for attachment to a computer. Using thumbscrew 34 on access door 13, a user can rotate the access door 13 out of the way, providing access to enable computer cable C to be attached to a computer PCMCIA port or other type of connector port. Computer cable connector C rests on the base 15, at an appropriate height determined by front portion 38. Once the cable is attached to the computer, the access door is rotated to a closed position and thumbscrew 34 is tightened to hold the access door 13 in such closed position. In this embodiment, a pad may be provided in the access door 13 to hold the cable connector C to the base 15. The radius of the portion of access door 13 wherein thumbscrew 34 penetrates can rest against cable connector C to keep it in place. Base plate 72 can be screwed into the bottom of the computer using existing hardware.

When two cables are attached to the computer within the protector assembly 10, cable clamp 41 is positioned out of the way of cable aperture 27; that is, substantially parallel to the computer cable. The access door 13 provides sufficient clamping force to hold both cables in place.

Figure 11:
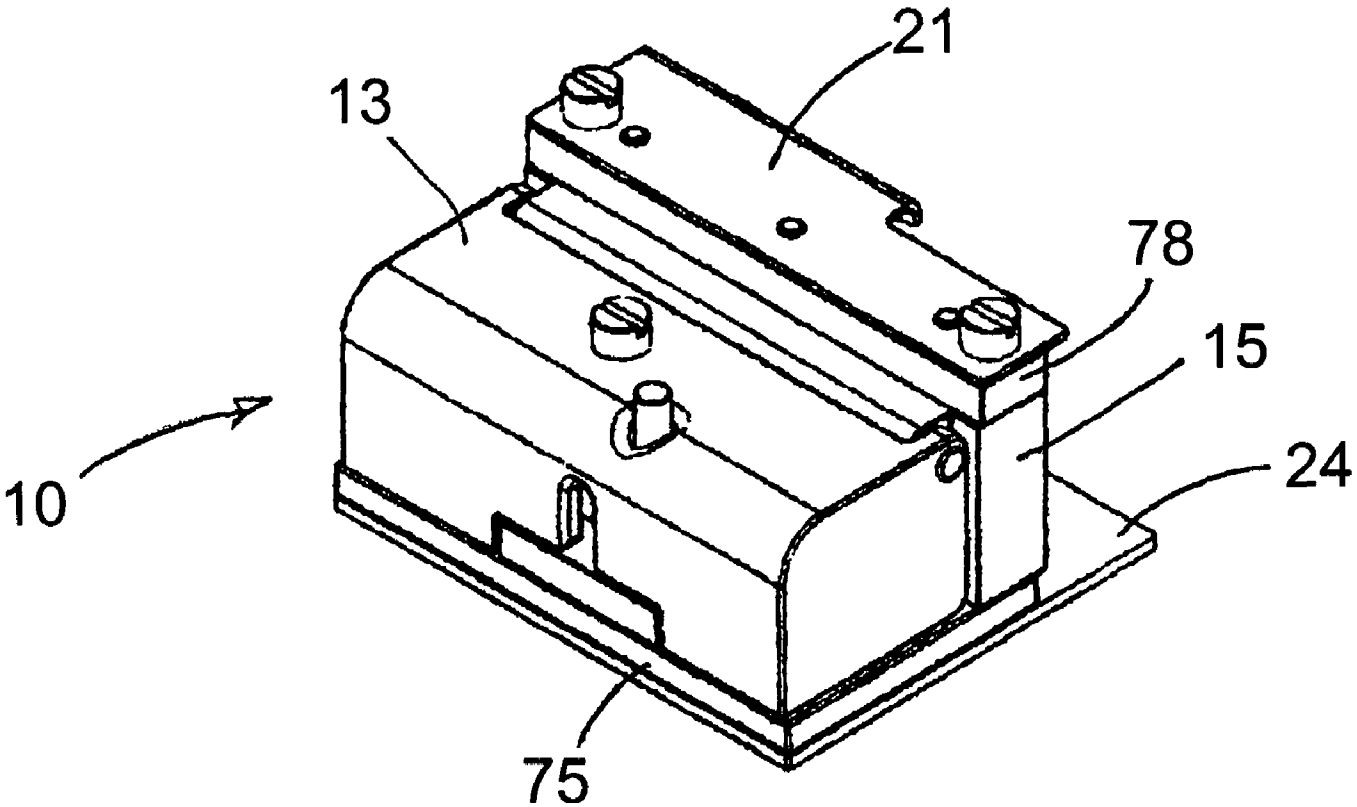
FIG. 11 is a perspective view of an assembly according to an alternate embodiment of the present invention.
Figure 12:
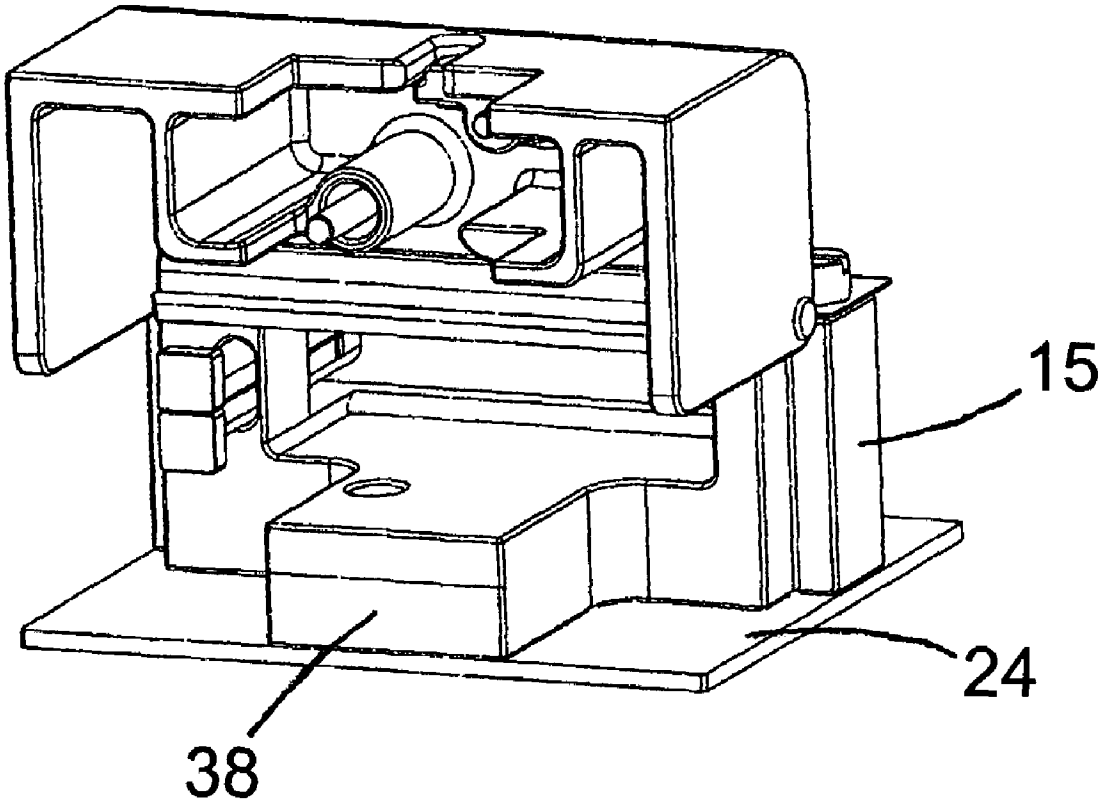
FIG. 12 is a perspective view, with the cover open, of an assembly according to a further alternate embodiment of the present invention.

Referring to FIG. 11, assembly 10 can be modified to enable attachment to various size computers. Base shim 75 can be inserted to raise the height of base 15 to ensure that the cable connector can align vertically with a port on the computer. Upper shim 78 can be used to vertically adjust the height of upper mount plate 21 in order to enable the assembly to be attached to the computer. In an alternate embodiment, as shown in FIG. 12, base 15 may be thicker to enable a larger vertical height of the front portion 38.

The invention has been described with references to a preferred embodiment. While specific values, relationships, and materials have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art could modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is intended to include all such modifications, alternatives and other embodiments insofar as they come within the scope of the appended claims or equivalents thereof. It should be understood, therefore, that the invention may be practiced otherwise than as specifically set forth herein. Consequently, the present embodiments are to be considered in all respects as illustrative and not restrictive.

What is claimed is:

1. A cable connector protector, comprising:

a base mounted on a lower plate;

an access cover, having a front section said access cover being pivotably attached to said base and selectively movable between a closed position and an open position, and said front section having at least one aperture therein; and means for attaching said connector protector to a computer.

2. The connector protector of claim 1, further comprising:

means for holding said access door in the closed position.

3. The connector protector of claim 2, wherein said means for holding said access door in the closed position comprises at least one thumbscrew.

4. The connector protector of claim 3, further comprising:

at least one screw socket attached to said lower plate for receiving said at least one thumbscrew.

5. The connector protector of claim 1, further comprising:

a shim between said base and said upper mount plate.

6. The connector protector of claim 1, further comprising:

means for securing said upper mount plate to said base wherein said upper mount plate is attached to said base such that said curved segment can overlap at least a portion of said computer.

7. The connector protector of claim 5, wherein said means for securing said upper mount plate to said base comprises at least one thumbscrew.

8. The connector protector of claim 7, further comprising:

at least one screw socket attached to said lower plate for receiving said at least one thumbscrew.

9. The connector protector of claim 1 said access cover further comprising:

a cable clamp selectively movable between a clamped position and an unclamped position, such that said cable clamp at least partially occludes said aperture in said front section of said access cover when said clamp is in the clamped position.

10. The connector protector of claim 1, further comprising:

an alignment plate attached to said lower plate, said alignment plate enabling said connector protector for attachment to said computer.

11. The connector protector of claim 1, further comprising:

a base shim between said base and said lower plate.

* * * * *